United States Patent [19]

Igarashi

[11] Patent Number: 4,822,771

[45] Date of Patent: Apr. 18, 1989

[54] HEAT-SENSITIVE RECORDING MATERIAL

[75] Inventor: Akira Igarashi, Shizuoka, Japan

[73] Assignee: Fuji Photo Film Co., Ltd., Kanagawa, Japan

[21] Appl. No.: 93,838

[22] Filed: Sep. 8, 1987

[30] Foreign Application Priority Data

Sep. 8, 1986 [JP] Japan ..... 61-211313

[51] Int. Cl.[4] ..... B41M 5/18

[52] U.S. Cl. ..... 503/226; 427/152; 428/330; 428/913; 428/914; 503/207; 503/216

[58] Field of Search ..... 503/200, 207, 226, 209, 503/216; 427/150–152; 428/330, 341, 342, 913, 914

[56] References Cited

U.S. PATENT DOCUMENTS 4,226,912 10/1980 Iwasaki et al. ..... 427/151

4,236,732 12/1980 Murakami et al. ..... 428/913

4,355,070 10/1982 Oeda ..... 427/150

FOREIGN PATENT DOCUMENTS 1118287 6/1986 Japan ..... 503/200

2145074 3/1985 United Kingdom ..... 503/207

*Primary Examiner*—Bruce H. Hess

*Attorney, Agent, or Firm*—Sughrue, Mion, Zinn, Macpeak & Seas

[57] ABSTRACT

A heat-sensitive recording material comprising a support provided thereon a heat-sensitive recording layer containing a colorless electron donating dye precursor and an electron accepting compound, wherein calcium carbonate including calcium hydroxide in an amount of from 1 to 5 wt % is incorporated into at least one of said heat-sensitive layer and an intermediate layer provided between said heat-sensitive layer and said support.

10 Claims, No Drawings

HEAT-SENSITIVE RECORDING MATERIAL

FIELD OF THE INVENTION

The present invention relates to a heat-sensitive recording material, and more particularly, to a heat-sensitive recording material using a color forming reaction between a colorless or slightly colored electron donating dye precursor and an electron accepting compound.

BACKGROUND OF THE INVENTION

A so-called two-component type heat-sensitive recording material using color a forming reaction between a colorless or slightly colored electron donating dye precursor and an electron accepting compound is disclosed in Japanese Patent Publication Nos. 14039/70 (corresponding to U.S. Pat. No. 3,539,375) and 4160/68 and so on. The two-component color forming type heat-sensitive recording material is prepared by dispersing a colorless or slightly colored electron donating dye precursor (hereinafter referred to as a "color former") and an electron accepting compound (hereinafter referred to as a "developer") into a fine particle state, mixing a binder and the like therewith so that these two heat-sensitive compounds are not in contact with each other and coating the mixture on a support. Particles of one or both of these heat-sensitive compounds are fused and caused to contact each other upon heating, resulting in a color forming reaction to conduct recording. Such two-component color forming type heat-sensitive recording materials are advantageous in such points that: (1) primary coloration is conducted and therefore development is unnecessary; (2) paper quality is similar to that of general paper; (3) handling is easy; (4) color density is high; and (5) upon color formation various hues can be obtained. Accordingly such recording materials are very valuable.

Recently, a heat-sensitive recording material has widely been used particularly in the field of facsimile transmissions, recorders and printers. With such increasing additional usage in the field of facsimile transmissions, facsimile recording rates have been increased. Thus, a strong demand has arisen for heat-sensitive recording materials which have a short pulse, that is, which have the ability to undergo color formation having a sufficient color density with a low heat energy input. Various approaches have accordingly been made, as disclosed in Japanese Patent Application (OPI) Nos. 18739/83, 67083/84 and 54884/85 (the term "OPI" as used herein refers to a "published unexamined Japanese Patent Application").

However, heat-sensitive recording materials which form color with such a low heat energy input have a serious problem in that they readily form color with various other impacts, that is, a chemical impact of acid substances included in a support and surface active agents added to improve surface coating properties and a physical impact of pressure and heat generated by friction, whereby fog formation takes place, resulting in largely reducing the commercial value thereof.

SUMMARY OF THE INVENTION

An object of the present invention is to provide a heat-sensitive recording material comprising a support having provided thereon a heat-sensitive recording layer mainly containing a color former and a developer, wherein a white degree is high and fog formation hardly takes place.

The object of the present invention can be attained by a heat-sensitive recording material comprising a support having provided thereon a heat-sensitive recording layer containing a colorless electron donating dye precursor (color former) and an electron accepting compound (developer), wherein calcium carbonate including calcium hydroxide in an amount of from 1 to 5 wt%, preferably from 1 to 3 wt%, is incorporated into the heat-sensitive recording layer and/or into an intermediate layer provided between the heat-sensitive recording layer and the support.

DETAILED DESCRIPTION OF THE INVENTION

Calcium carbonate is classified into three types in accordance with methods for preparing calcium carbonate. The three types are heavy calcium carbonate, precipitated calcium carbonate, and chalk. The calcium carbonate used in the present invention is precipitated calcium carbonate.

The methods for industrially preparing precipitated calcium carbonate are (1) reaction of calcium hydroxide with carbon dioxide, (2) reaction of calcium chloride with sodium carbonic anhydride, and (3) reaction of calcium hydroxide with sodium carbonic anhydride. These reaction processes can be represented as follows.

$$Ca(OH)_2 + CO_2 \rightarrow CaCO_3 + H_2O \quad (1)$$

$$CaCl_2 + Na_2CO_3 \rightarrow CaCO_2 + 2NaCl \quad (2)$$

$$Ca(OH)_2 + Na_2CO_3 \rightarrow CaCO_3 + 2NaOH \quad (3)$$

Calcium carbonate used in the present invention is prepared by the reaction of calcium hydroxide with carbon dioxide, wherein unreacted calcium hydroxide is present in the thus formed calcium carbonate by selecting predetermined synthesis conditions. The preparation of the calcium carbonate used in the present invention by reacting calcium hydroxide with carbon dioxide can be conducted according to *Pigment Handbook*, Vol. 1, pp 119 to 128 (John Wiley & Sons, New York 1973).

By including such calcium carbonate in a heat-sensitive recording material, the pH of the recording layer can stably be maintained as weakly alkaline, thereby preventing the reaction of a color former with an acid, and as a result, a heat-sensitive recording material having a high white degree can be obtained.

Accordingly, when such a color former having a high color forming property as that having a high pKa is used, a heat-sensitive recording material having a high white degree and where fog formation hardly takes place can be obtained.

When the content of calcium hydroxide is not more than 1 wt%, the above-described pH adjusting effect is insufficient, and when it exceeds 5 wt%, the original function as a pigment does not work and calcium hydroxide may unfavorably react with the developer.

Calcium carbonate of the present invention is preferably obtained by controlling the reaction of calcium hydroxide with carbon dioxide. Calcium carbonate having added therein calcium hydroxide afterwards is not preferred, because it has a small effect in stabilizing the pH of a heat-sensitive color forming layer, that is, the buffer effect is small.

The method for preparing the heat-sensitive recording material of the present invention is described below.

The heat-sensitive recording material of the present invention can be prepared by mixing and dispersing a color former and a developer in a ball mill or a sand mill in the presence of a liquid component to form dispersions thereof. The color former and developer are dispersed until the particle size thereof is several microns or lower, and then the dispersions of color former and developer are mixed together. The color former and developer are generally dispersed in an aqueous solution of a water soluble high molecular weight substance such as polyvinyl alcohol, and a sensitizing agent is also dispersed and added thereto, if necessary. The sensitizing agent may be added to one or both of the color former and the developer and may be dispersed therewith at the same time.

The calcium carbonate of the present invention is then added to the mixture of the dispersions of the developer and the color former, and various additives are added thereto, if necessary.

The colorless electron donating dye precursor used in the present invention includes a slightly colored electron donatong dye precursor.

Examples of color formers preferably used in the present invention include triarylmethane type compounds, diphenylmethane type compounds, xanthene type compounds, thiazine type compounds, spiropyran type compounds and the like.

Specific examples of the triarylmethane type compounds include 3,3-bis(p-dimethyolaminophenyl-6-dimethylaminophthalide (i.e., Crystal Violet Lactone), 3,3-bis(p-dimethylamino-phenyl)phthalide, 3-(p-dimethylamino-phenyl)-3-(1,3-dimethylindol-3-yl)phthalide and 3-(p-dimethylaminophenyl)-3-(2-methylindol-3-yl)phthalide.

Specific examples of the diphenylmethane type compound include 4,4'-bis-dimethylamino-benzhydrin benzylether, N-halophenyl-leucoauramine and N-2,4,5-trichlorophenyl leucoauramine.

Specific examples of the xanthene type compounds include rhodamine β-anilinolactam, rhodamine(p-nitroanilino)lactam, rhodamine β-(p-chloro-anilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexyl methyl-aminofluoran, 2o-chloroanilino-6-diethylaminofluoran, 2-m-chloroanilino-6-diethylaminofluoran, 2-(3,4-dichloro-anilino)-6-diethylaminofluoran, 2-octylamino-6-diethyl-aminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylamino-fluoran, 2-anilino-3-chloro-6-diethylaminofluoran, 2-di-phenylamino-6-diethylaminofluoran, 2-anilino-3-methyl-6-di-phenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfuoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-chloro-6-N-ethyl-N-isoamylaminofluoran, 2-anilino-3-methyl-6-ethylisoamylfluoran and 2-anilino-3-methyl-6-methylpropylaminofluoran.

Specific examples of the thiazine type compounds include benzoyl leucomethylene blue and p-nitrobenzylleucomethylene blue.

Specific examples of the spiropyran type compounds include 3-methyl-spiro-dinaphthopyran, 3-ethyl-spiro-dinaphthopyran, 3,3'-dichloro-spiro-dinaphthopyran, 3-benzylspiro-dinaphthopyran, 3-methylnaphtho-(3-methoxybenzo)spiropyran and 3-propyl-spiro-dibenzopyran.

The color formers can be used alone or in combination.

Among the above-described color formers, those having a high pKa, specifically, a pKa of 2.5 or higher are preferred, because a high print density can be obtained with a short pulse and color formation is very fast. Normally, a color former having such a high pKa has a disadvantage in that it readily forms fog. Accordingly, use of calcium carbonate of the present invention is very effective.

The amount of the color former added to the heat-sensitive layer is preferably from 0.1 to 0.8 g/m$^2$, and more preferably from 0.2 to 0.5 g/m$^2$.

Examples of a developer preferably used in the present invention include phenol compounds, organic acids or the methal salts thereof (e.g., 3,5-tert-butylsalicilic acid, 3,5-α-methylbenzylsalicilic acid, a zinc salt or a an alminum salt thereof, etc.) and oxybenzoate. The phenol compounds and osybenzoate are particularly preferred because of their high color forming property.

The developers used in the present invention are preferably those compounds represented by formulae (I) to (V)

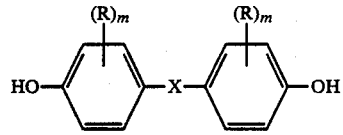

(1)

In formula (I), X represents S, O, $SO_2$, $S_2$,

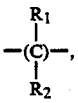

wherein $R_1$ and $R_2$ each represents a hydrogen atom or an alkyl group having from 1 to 8 carbon atoms, or $R_1$ and $R_2$ combine to form a cycloalkyl group, or $R_2$ is an ester represented by —COOR' wherein R' represents an alkyl group having from 1 to 10 carbon atoms; m represents an integer of from 0 to 3; and R represents a straight or branched alkyl group having from 1 to 8 carbon atoms or a halogen atom.

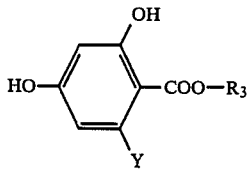

(II)

In formula (II), Y represents a hydrogen atom, —$CH_3$ or —OH; and $R_3$ represents

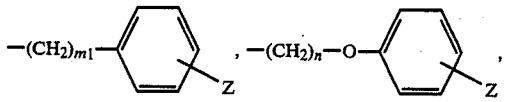

or a straight or branched alkyl group having from 1 to 6 carbon atoms, $m_1$ and n each represents an integer of from 0 to 3, and Z represents a hydrogen atom, a halogen atom, or —$CH_3$.

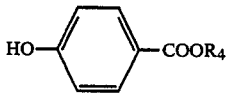

(III)

In formula (III), $R_4$ represents a benzyl group, a halogen atom or a straight or branched alkyl group having from 1 to 8 carbon atoms.

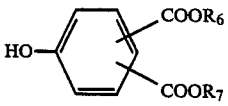

(IV)

In the formula (IV), $R_6$ and $R_7$ each represents an alkyl group having from 1 to 8 carbon atoms.

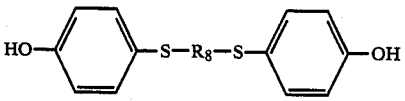

(V)

In formula (V), $R_8$ represents an alkylene group having from 1 to 5 ether bonds Specific examples of compounds represented by formulae (I) to (V) include 2,2-bis(4'-hydroxyphenyl)propane (bisphenol A), 2,2-bis(4'-hydroxyphenyl)pentane, 2,2-bis(4'-hydroxyphenyl)cyclohexane, 1,1bis(4'-hydroxyphenyl)propane, 1,1-bis(4'-hydroxyphenyl)butane, 1,1-bis(4'-hydroxyphenyl)pentane, 1,1-bis(4'-hydroxy-phenyl)hexane, 1,1-bis(4'-hydroxyphenyl)heptane, 1,1-bis(4'-hydroxy-phenyl)-2-methylpentane, 1,1bis(4'-hydroxyphenyl)-2-ethylhexane, 1,1-bis(4'-hydroxyphenyl)dodecane, 3,3-bis(4'-hydroxyphenyl)-pentane, 1,2-bis(4'-hydroxyphenyl)ethane, 1,1bis(4'-hydroxyphenyl)sulfon, 1,1-bis(4'-hydroxyphenyl)ether, 2,2-bis(4'-hydroxy-3',5'-dichlorophenyl)butane, phenyl 2,4-dihydroxybenzoate, phenyl 2,4-dihydroxy-4'-chlorobenzoate, phenyl 2,4-dihydroxy-6-methylbenzoate, phenyl 2,4,6-trihydroxybenzoate, phenyl 2,4-dihydroxy-6,4'-dimethylbenzoate, phenyl 2,4-dihydroxy-6-methyl-4'-chlorobenzoate, benzyl 2,4-dihydroxy-6-methylbenzoate, benzyl 2,4,6-trihydroxybenzoate, benzyl 2,4-dihydroxy-6,4'-dimethylbenzoate, benzyl 2,4-dihydroxy-6-methyl-4'-chlorobenzoate, ethyl 4-hydroxybenzoate, propyl 4-hydroxybenzoate, isopropyl 4-hydroxybenzoate, benzyl 4-hydroxybenzoate, 2-ethylhexyl 4-hydroxybenzoate, benzyl 4-hydroxy-4'-chlorobenzoate, benzyl 4-hydroxy-4'-methylbenzoate, benzyl 4-hydroxy-4'-ethylbenzoate, dimethyl 3-hydroxy-m-phtahlate, diethyl 3-hydroxy-m-phthalate, methylethyl 3-hydroxy-m-phtahlate, dibutyl 3-hydroxy-m-phthalate, dimethyl 3-hydroxy-o-phthalate, diethyl 3-hydroxy-o-phthalate, methyl bis-(4-hydroxyphenyl)acetate, and the like.

Specific examples of compounds represented by formula (V) include

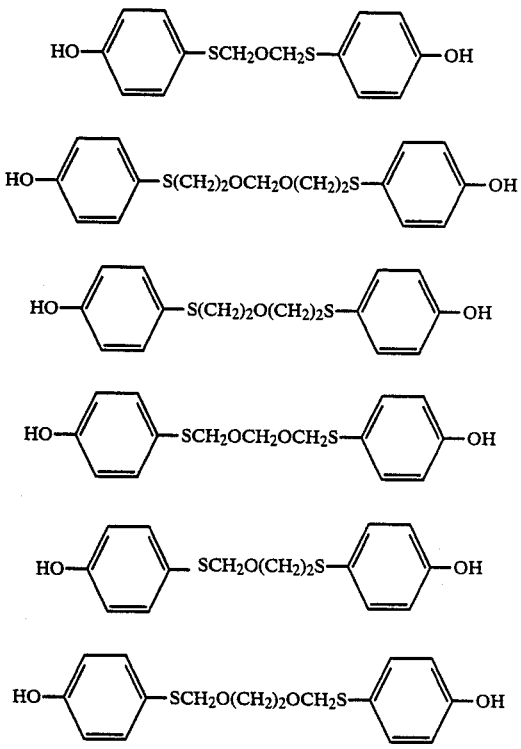

Preferred examples of useful developers represented by the formulae (I) to (V) include bis-hydroxycumylbenzenes or bis-hydroxy-α-methylbenzyl benzenes, such as 1,4-bis-p-hydroxycumylbenzene, 1,4-bis-m-hydroxycumylbenzene, 1,3-bis-p-hydroxycumylbenzene, 1,3-bis-m-hydroxycumylbenzene, 1,4-bis-o-hydroxycumylbenzene, 1,4-bis-p-hydroxy-α-methylbenzylbenzene, 1,3-bis-p-hydroxy-α-methylbenzylbenzene, and preferred compounds are not limited thereto.

The amount of the electron accepting compound added to the heat-sensitive layer is preferably from 0.3 to 1.5 g/$m^2$, and more preferably from 0.5 to 1.0 g/$m^2$.

The above-described developers can preferably be used in an amount of from 50 to 800 wt%, and more preferably from 100 to 500 wt%, based on the weight of the color formers, and they can be used alone or in combination of two or more thereof.

In the heat-sensitive recording material of the present invention, a heat meltable substance, that is, a sensitizer can be incorporated into the heat-sensitive color forming layer in order to improve heat responsiveness.

Preferred examples of the sensitizer include compounds represented by the formulae (VI) to (XI)

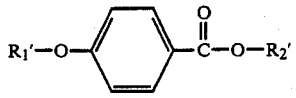

(VI)

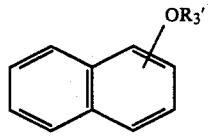

(VII)

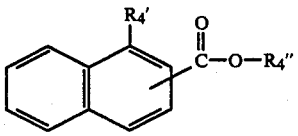

(VIII)

$R_5'NHCONH_2$ (IX)

$R_6'CONH—R'_7$ (X)

In formulae (VI) to (X), $R_1'$, $R_2'$, $R_3'$ and $R_4''$ each represents a phenyl group or a benzyl group, which can be substituted with a lower alkyl group or a halogen atom. $R_5'$ and $R_6'$ each represents an alkyl group having from 12 to 24 carbon atoms and $R_7'$ represents a hydrogen atom or a phenyl group.

When a phenyl group or a benzyl group represented by $R_1'$, $R_2'$, $R_3'$ and $R_4''$ in formulae (VI) to (X) is substituted with a lower alkyl group, the number of carbon atoms thereof is generally from 1 to 8, and preferably from 1 to 3. When they are substituted with a halogen atom, it is preferably a fluorine atom. In formula (VIII), $R_4''$ represents a hydrogen atom or a hydroxyl group.

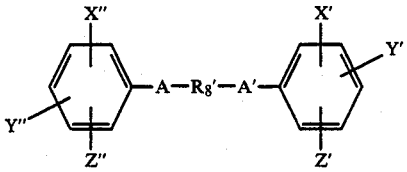

(XI)

wherein $R_8'$ represents a divalent group preferably an alkylene group, an alkylene group having an ether bond, an alkylene group having a carbonyl group, an alkylene group having an halogen atom, an alkylene group having an unsaturated bond. An alkylene group and an alkylene group having a ether bond are more preferred. X'', Y'', Z'', X', Y' and Z' may be the same or different and each represents a hydrogen atom, a halogen atom, an alkyloxycarbonyl group and an aralkyloxycarbonyl group. A and A' may be the same or different and each represents —O— or —S—.

The compounds represented by the above-described formulae (VI) to (XI) have a melting point of, preferably, from 70° to 150° C., and more preferably from 80° to 130° C.

Specific examples of the above compounds includek benzyl p-benzyloxybenzoate (mp. 103° C.), β-naphthylbenzyl ether (mp. 105° C.), stearic acid amide (mp. 108° C.), palmitic acid amide (mp. 103° C.), N-phenyl stearic acid amide (mp. 96° C.), N-stearylurea (mp. 110° C.), phenyl β-naphthoate (mp. 92° C.), phenyl 1-hydroxy-2-naphthoate (mp. 92° C.), β-naphthol(p-chlorobenzyl)ether (mp. 115° C.), β-naphthol(p-methylbenzyl)ether (mp. 96° C.), α-naphthylbenzyl ether (mp. 76° C.), 1,4-butandiol-p-methylphenyl ether (mp. 93° C.), 1,4-propanediol-bis-p-methylphenyl ether (mp. 93° C.), 1,4-butandiol-bis(p-isopropylphenyl)ether (mp. 79° C.), 1,4-butandiol-bis(p-t-octylphenyl)ether (mp. 99° C.), 2-phenoxy-1-p-tolyloxyethane (mp. 104° C.), 1-phenoxy-2-(4-ethylphenoxy)-ethane (mp. 106° C.), 1-phenoxy-2-(4-chlorophenoxy)ethane (mp. 77° C.), 1,4-butanediol diphenyl ehter (mp. 98° C.), diethyleneglycol-bis(4-methoxyphenyl)ether (mp. 101° C.), 1,2-bis(m-methylphenoxy)ethane (mp. 98° C.) and 1,2-bis(p-methoxyphenylthio)ethane (mp. 108° C.).

The above-described sensitizer can be used alone or in combination, and can be used in an amount of from 10 to 200 wt%, and preferably from 20 to 150 wt%, based on the weight of the developer, in order to obtain sufficient heat responsiveness.

As a water soluble binder, those compounds which dissolve in water at 25° C. in an amount of 5 wt% or higher are preferred. Specific examples thereof include polyvinyl alcohol, methylcellulose, carboxymethyl cellulose, hydroxyethyl cellulose, starches including modified starches, gelatin, gum arabic, casein, hydrolysis product of copolymers of styrene and maleic anhydride, hydrolysis product of copolymers of ethylene and maleic anhydride, hydrolysis product of copolymers of isobutylene and maleic anhydride, saponified substances of silanol modified polyvinyl alcohol, carboxy modified polyvinyl alcohol, copolymers of polyacrylamide and copolymers of vinylacetate and polyacrylic acid.

The amount of the binder used for dispersing a color former and a developer is from 2 to 25%, preferably from 5 to 20% based on the color former and the developer.

If necessary, the above-described water soluble high molecular weight compounds can be added later as a binder.

In additon to using the above-described water soluble high molecular weight compounds as a binder, latex such as styrene and butadiene rubber latexes can be added.

Further, the calcium carbonate of the present invention is added to prevent so-called head stain, which takes place when printing is conducted with a thermal head and melt substances of a color former, a developer and a sensitizer transfer to the thermal head. Fatty acids, wax, and metal soaps are additionally added to increase the parting property from the head.

The additive amount of calcium carbonate in the present invention is preferably from 20 to 200 wt% based on the total amount of color former, developer and sensitizer. Calcium carbonate having an oil absorption degree of 40 ml/100 g in accordance with JIS K5101 is preferred.

In order to prevent head stain, in addition to calcium carbonate, other high oil absorbent pigments can be used such as calcined kaolin, amorphous silica, diatomaceous earth, magnesium carbonate, barium carbonate, talc or a filler of urea, formalin resin, etc.

The wax includes an emulsion of waxes such as paraffin wax, microcrystalline wax, carnauba wax, methylol stearolamide, polyethylene wax and polystyrene wax.

The metal soaps include polyhydric metal salts of higher fatty acids such as zinc stearate, aluminum stearate, calcium stearate or zinc oleate. Among these, a zinc salt is preferred, and zinc stearate and zinc oleate are more preferred.

In a heat-sensitive recording material of the present invention, compounds capable of preventing image disappearance and of making formed images fast can be incorporated into the heat-sensitive color forming layer.

As such color disappearance-preventing agents, phenol derivatives, and particularly hindered phenol compounds are effective. Preferable examples of those compounds are compounds represented by formulae (XII) to (XV).

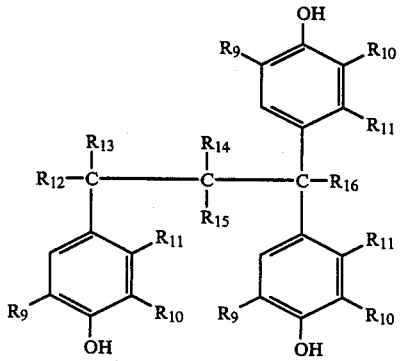

(XII)

In formula (XII), $R_9$ represents a branched alkyl group having from 3 to 8 carbon atoms, $R_{10}$ represents a hydrogen atom or a branched alkyl group having from 3 to 8 carbon atoms, $R_{11}$ represents a hydrogen atom or an alkyl group having from 1 to 3 carbon atoms, $R_{12}$ represents a hydrogen atom or an alkyl group having from 1 to 8 carbon atoms, $R_{13}$, $R_{14}'$ and $R_{15}$ each represens a hydrogen atom or an alkyl group ahving from 1 to 3 carbon atoms, and $R_{16}$ represents a hydrogen atom or an alkyl group having from 1 to 8 carbon atoms.

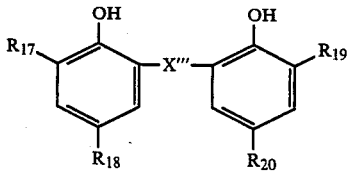

(XIII)

In formula (XIII), $R_{17}$ and $R_{19}$ each represents a branched alkyl group having from 3 to 8 carbon atoms, $R_{18}$ and $R_{20}$ each represents an alkyl group having from 1 to 8 carbon atoms, X''' represents S, O, $SO_2$, $S_2$,

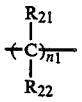

wherein $n_1$ represents an integer of from 0 to 3, a cyclopentylene group, or a cyclohexylene group, and $R_{21}$ and $R_{22}$ each represents a hydrogen atom or an alkyl group having from 1 to 8 carbon atoms.

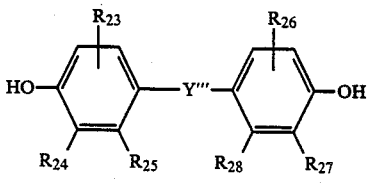

(XIV)

In formula (XIV), $R_{23}$ and $R_{24}$ each represents a branched alkyl group having from 3 to 8 carbon atoms, $R_{24}$, $R_{25}$, $R_{27}$ and $R_{28}$ each represents a hydrogen atom or an alkyl group having from 1 to 8 carbon atoms, Y''' represents S, O, $SO_2$, $S_2$,

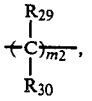

wherein $m_2$ is an integer of from 0 to 3, $R_{29}$ and $R_{30}$ each represents a hydrogen atom or an alkyl group having from 1 to 8 carbona toms, or $R_{29}$ and $R_{30}$ may bond to form a cyclic pentamethylene group.

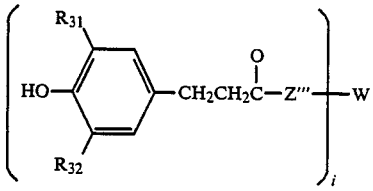

(XV)

In formula (XV), $R_{31}$ and $R_{32}$ each represents branched alkyl groups having from 3 to 8 carbon atoms Z''' represents —NH—, $—O(CH_2)_{n2}—$, wherein $n_2$ represents an integer of from 1 to 5, i represents an integer of from 1 to 4, and when i is 1, W represents an alkyl group having from 1 to 18 carbon atoms, and when i is 2, W represents S, O,

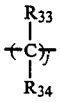

wherein $R_{33}$ and $R_{34}$ each represents a hydrogen atom or an alkyl group having from 1 to 8 carbon atoms, j represents an integer of from 0 to 8, and when i is 3, W representgs

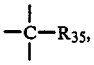

wherein $R_{35}$ represents a hydrogen atom or an alkyl group ahving from 1 to 8 carbon atoms, and when i is 4, W represents

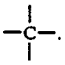

Typical examples of the phenol derivatives represented by the formulae (XII) to (XV) are shown below.

(A) The phenol derivatives as represented by formula (XII) include 1,1,3-tris(2-methyl-4-hydroxy-5-tert-butylphenyl)butane, 1,1,3-tris(2-ethyl-4-hydroxy-5-tert-butylphenyl)butane, 1,1,3-tris(3,5-di-tert-butyl-4-hydroxyphenyl)butane, and 1,1,3-tris(2-methyl-4-hydroxy-5-tert-butylphenyl)propane.

(B) The phenol derivatives as represented by formula (XIII) include 2,2'-methylene-bis(6-tert-butyl-4-methylphenol) and 2,2'-methylene-bis(6-tert-butyl-4-ethylphenol).

(C) The phenol derivatives as represented by formula (XIV) include 4,4'-butylidene-bis(6-tert-butyl-3-methylphenol) and 4,4'-thio-bis(3-methyl-6-tert-butylphenol).

(D) The phenol derivatives as represented by formula (XV) include

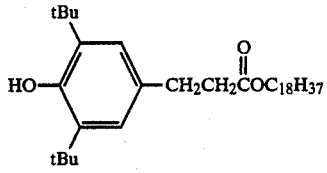

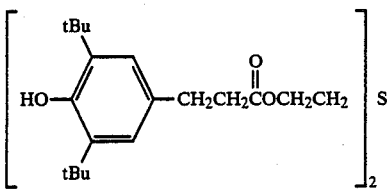

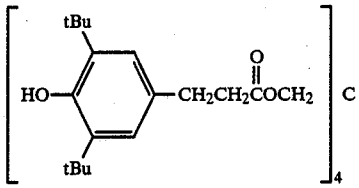

The additive amount of the phenol compounds represented by the formulae (XI) to (XIV) is preferably from 1 to 200 wt%, and more preferably from 5 to 50 wt%, based on the weight of the developer.

Further, the color disappearance preventing agent are ground dispersed alone similar to the developer and are added to the other dispensions, or they are mixed with the developer or the sensitizer and then dispersed and added to the other dispersions.

The thus obtained heat-sensitive coating solution is coated on a support. Suitable supports are paper, synthetic paper or plastic and paper is the most generally used.

Paper having a white degree of 80% or higher and a smooth degree of 50 sec or higher is preferred.

The above-described inorganic or organic pigments (i.e., calcium carbonate, calcined kaolin, amorphous silica, diatomaceous earth, magnesium carbonate, barium carbonate, talc or a filler of urea, formalin resin, etc.) may be added upon preparing the paper, or the pigments are coated as a subbing layer on the paper in order to obtain a very smooth property.

The additive amount of pigments added upon preparing the paper is preferably from 5 to 30 wt% based on the weight of the pulp. The additive amount of pigments used for coating a subbing layer is preferably form 4 to 10 g/m$^2$.

When the calcium carbonate of the present invention is incorporated in a subbing layer, the calcium carbonate can be omitted in the heat-sensitive recording layer.

The calcium carbonate of the present invention is effective particularly when an acid paper having a pH after cool extraction of 6 or lower is used as a paper support.

The coating amount of a heat-sensitive recording layer is generally from 2 to 10 g/m$^2$ by solid content. The lower limit is determined by the color density formed upon heating and the upper limit is determined by economic factors.

A heat-sensitive recording paper mainly comprising a developer and a color former has such a defect that color is easily formed not only by heat but also by solvents such as alcohols, ketones or the like due to their nature. Therefore, a protective layer can be provided on the heat-sensitive color forming layer in order to eliminate this defect.

The materials for the protective layer may be the high molecular weight substances which are described above as the binder for the heat-sensitive layer. Those substances are used after they are cross-linked by aldehyde and the like, if necessary. The thickness of the protective layer is preferably from 1 to 5 $\mu$m.

The present invention will now be illustrated in more detail by the following Examples, but it should not be limited thereto.

Unless otherwise specified, all percents, ratios, etc. are by weight.

EXAMPLES 1 TO 3

Five grams of 2-anilino-3-methyl-6-cyclohexylmethylaminofluoran as a color former and 25 g of 5% polyvinyl alcohol ("PVA-105", manufactured by Kuraray Co., Ltd.) were dispersed in a 100 ml ball mill for one day and one night to obtain a dispersion of a color former.

Ten grams of bisphenol A as a developer and 10 g of $\beta$-naphthylbenzyl ether as a sensitizer were mixed and dispersed together with 100 g of 5% polyvinyl alcohol ("PVA-105⇄, manufactured by Kuraray Co., Ltd.) in a 300 ml ball mill for one day and one night to obtain a mixed dipsersion of a developer and a sensitizer.

25 g of calcium carbonate (content of calcium hydroxide is shown in Table 1) prepared by the reaction of calcium hydroxide with carbon dioxide as a pigment were dispersed in 30 g of a 0.5% aqueous solution of sodium hexamethaphosphate by a homogenizer to obtain a pigment dispersion.

Calcium carbonate used therein had an oil absorption degree of from 50 ml/100 g to 55 ml/100 g.

The above three dispersions were mixed and 10 g of a 30% dispersion of zinc stearate ("Handrin Z-7", manufactured by Chukyo Fat and Oil Co., Ltd.) were added thereto to obtain a coating solution. The solution was coated on a high quality paper having a basis weight of 50 g/m$^2$ so that the coating amount was 5 g/m$^2$ by solid content, dried and calendering at 2 kgw/cm was conducted to obtain samples.

The samples were printed using a print tester manufactured by Kyocera Co., Ltd. with a pulse width of 1.2 ms, 0.35 W/dot, and print density of 8 dot/mm$\times$7.7 dot/mm (35 mJ/mm$^2$) and the density was measured by a Macbeth reflective densitometer "918 type" through a #106 filter.

As the values obtained increased, print densities are higher and more preferable. The stain of the thermal heat after printing was visually checked.

For evaluating fog formation, coated papers were allowed to stand at 40° C. and a relative humidity of 90% for 24 hours and the reflective densities before and after the test were measured. As the values obtained decrease, fog formation is less and the white degree is higher. The results are shown in Table 1.

COMPARATIVE EXAMPLES 1 TO 4

The same procedure as in example 1 was repeated to obtain samples except that different calcium carbonate and inorganic pigments according to the present invention were used. The results are shown in Table 1.

COMPARATIVE EXAMPLE 5

A mixture of calcium carbonate having calcium hydroxide in an amount of 0.5% with 2% calcium hydroxide was used. The results are shown in Table 1.

EXAMPLES 4 TO 5

Into the dispersion of calcium carbonate used in Example 1, styrene butadiene latex was added in an amount of 15 wt% (solid content) based on the weight of calcium carbonate and the dispersion was coated on a high quality paper so that the coated amount of calcium carbonate was 6 g/m$^2$ and thus an undercoated paper was obtained.

The heat-sensitive coating solution as used in Example 1 and Comparative Example 3 was coated on the thus obtained undercoated paper. The samples were evaluated in the same manner as in Example 1. The results are shown in Table 2.

TABLE 1

| Example | Pigments used | Print density | Fog before test | Fog after test | Head stain |
|---|---|---|---|---|---|
| Example 1 | Calcium carbonate (calcium hydroxide: 1.2%) | 1.18 | 0.05 | 0.08 | good |
| Example 2 | Calcium carbonate (calcium hydroxide: 2.5%) | 1.18 | 0.05 | 0.07 | good |
| Example 3 | Calcium carbonate (calcium hydroxide: 4.0%) | 1.12 | 0.06 | 0.08 | good |
| Comparative Example 1 | Calcium carbonate (calcium hydroxide: 0.5%) | 1.18 | 0.07 | 0.11 | good |
| Comparative Example 2 | Calcium carbonate (calcium hydroxide: 7.0%) | 1.10 | 0.05 | 0.10 | relatively poor |
| Comparative Example 3 | Calcinated kaolin | 1.20 | 0.09 | 0.18 | good |
| Comparative Example 4 | Amorphous silica | 1.01 | 0.05 | 0.16 | good |
| Comparative Example 5 | Mixture of calcium carbonate with calcium hydroxide | 1.18 | 0.05 | 0.12 | good |

TABLE 2

| Example | Pigments used | Print density | Fog before test | Fog after test | Head stain |
|---|---|---|---|---|---|
| Example 4 | Calcium carbonate (calcium hydroxide: 1.2%) | 1.26 | 0.04 | 0.06 | good |
| Example 5 | Calcinated kaolin | 1.29 | 0.05 | 0.07 | good |

It is understood from the results that addition of calcium carbonate according to the present invention is very effective for preventing fog formation.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support provided thereon a heat-sensitive recording layer containing a colorless electron donating dye precursor and an electron accepting compound, wherein a mixture of calcium carbonate and calcium hydroxide is incorporated into at least one of said heat-sensitive layer and an intermediate layer provided between said heat-sensitive layer and said support, said mixture having been prepared by the reaction of calcium hydroxide with carbon dioxide, wherein unreacted calcium hydroxide remains present in the thus formed mixture in an amount of from 1 to 5 wt% as a result of synthesis conditions.

2. A heat-sensitive recording material as claimed in claim 1, wherein said calcium carbonate includes calcium hydroxide in an amount of from 1 to 3 wt%.

3. A heat-sensitive recording material as claimed in claim 1, wherein said calcium carbonate including calcium hydroxide in an amount of from 1 to 5 wt% is prepared by a reaction of calcium hydroxide with carbon dioxide.

4. A heat-sensitive recording material as claimed in claim 1, wherein said colorless electron donating dye precursor has a pKa of 2.5 or higher.

5. A heat-sensitive recording material as claimed in claim 1, wherein the amount of said colorless electron donating dye precursor in said heat-sensitive layer is from 0.1 to 0.8 g/m$^2$.

6. A heat-sensitive recording material as claimed in claim 1, wherein said electron accepting compound is selected from bis-hydroxycumylbenzene and bis-hydroxy-α-methylbenzylbenzene.

7. A heat-sensitive recording material as claimed in claim 1, wherein the amount of said electron accepting compound in said heat-sensitive layer is from 0.3 to 1.5 g/m$^2$.

8. A heat-sensitive recording material as claimed in claim 1, wherein said electron accepting compound is used in an amount of from 50 to 800 wt% based on the weight of said colorless electron donating dye precursor.

9. A heat-sensitive recording material as claimed in claim 1, wherein said calcium carbonate including calcium hydroxide in an amount of from 1 to 5 wt% is incorporated in said heat-sensitive recording material in an amount of from 20 to 200 wt% based on the total amount of said colorless electron donating dye precursor, said electron accepting compound, and a sensitizer contained therein.

10. A heat-sensitive recording material as claimed in claim 1, wherein said heat-sensitive recording material further contains a sensitizer.

* * * * *